US012006801B2

(12) United States Patent
Bermudez et al.

(10) Patent No.: US 12,006,801 B2
(45) Date of Patent: Jun. 11, 2024

(54) EXPANDABLE LINER HANGER

(71) Applicant: Coretrax Americas Ltd., Houston, TX (US)

(72) Inventors: Jorge Bermudez, Houston, TX (US); Scott A. Benzie, Houston, TX (US); Andrei G. Filippov, Houston, TX (US)

(73) Assignee: Coretrax Americas Limited, Houston, TX (US)

( * ) Notice: Subject to any disclaimer, the term of this patent is extended or adjusted under 35 U.S.C. 154(b) by 0 days.

(21) Appl. No.: 17/583,898

(22) Filed: Jan. 25, 2022

(65) Prior Publication Data

US 2022/0145712 A1 May 12, 2022

Related U.S. Application Data

(63) Continuation of application No. 16/601,862, filed on Oct. 15, 2019, now Pat. No. 11,230,909.

(60) Provisional application No. 62/747,890, filed on Oct. 19, 2018.

(51) Int. Cl.
*E21B 43/10* (2006.01)
*E21B 23/01* (2006.01)

(52) U.S. Cl.
CPC ..... *E21B 43/108* (2013.01); *E21B 23/01* (2013.01); *E21B 43/103* (2013.01); *E21B 43/105* (2013.01)

(58) Field of Classification Search
CPC ..... E21B 23/01; E21B 43/10; E21B 43/103; E21B 43/108
See application file for complete search history.

(56) References Cited

U.S. PATENT DOCUMENTS

| | | | | |
|---|---|---|---|---|
| 4,498,534 | A | 2/1985 | Lindsey, Jr. | |
| 9,580,981 | B2 | 2/2017 | Zhong et al. | |
| 2003/0047322 | A1 | 3/2003 | Maguire et al. | |
| 2003/0106698 | A1 | 6/2003 | Simpson et al. | |
| 2003/0188868 | A1* | 10/2003 | Simpson | E21B 43/105 166/382 |
| 2005/0150654 | A1* | 7/2005 | Kirk | E21B 17/1078 166/241.1 |
| 2005/0236162 | A1 | 10/2005 | Badrak et al. | |
| 2008/0110641 | A1 | 5/2008 | Howlett et al. | |
| 2008/0210440 | A1 | 9/2008 | Stuart et al. | |
| 2012/0261116 | A1 | 10/2012 | Xu | |
| 2014/0174763 | A1 | 6/2014 | Zhong et al. | |

(Continued)

OTHER PUBLICATIONS

International Search Report and Written Opinion for Application No. PCT/US2019/056592 dated Jan. 10, 2020.

(Continued)

*Primary Examiner* — D. Andrews
(74) *Attorney, Agent, or Firm* — Patterson + Sheridan, LLP

(57) ABSTRACT

An expandable liner hanger includes an anchoring element having multiple circumferential ridges that include flow relief grooves which prevent buildup of hydrostatic pressure between the liner hanger and well casing during expansion of the liner hanger. Upon liner hanger expansion the ridges come in high interference with wellbore casing and couple the liner hanger to the wellbore casing. According to another embodiment of the invention, the ridges are formed by a spiral ridge extending along an outer periphery of the hanger thus providing a pressure relief passage for the fluid.

17 Claims, 3 Drawing Sheets

(56) References Cited

U.S. PATENT DOCUMENTS

2016/0090801 A1* 3/2016 Hazelip ..... E21B 43/108
166/382

OTHER PUBLICATIONS

USPTO Non-Final Office Action for U.S. Appl. No. 16/601,862 dated Oct. 2, 2020.
USPTO Final Office Action for U.S. Appl. No. 16/601,862 dated Jun. 2, 2021.
USPTO Issue Notification for U.S. Appl. No. 16/601,862 dated Jan. 5, 2022.
United Kingdom Examination Report for Application No. GB2105413.5 dated Apr. 5, 2022.

* cited by examiner

EXPANDABLE LINER HANGER

CROSS-REFERENCE TO RELATED APPLICATIONS

This application is a continuation application of U.S. application Ser. No. 16/601,862 filed on Oct. 15, 2019, which is a non-provisional application that claims the benefit of U.S. Application Ser. No. 62/747,890 filed on Oct. 19, 2018, the entire contents of is incorporated herein by reference thereto.

BACKGROUND OF THE INVENTION

Field of the Invention

This invention relates to equipment and methods used in subterranean wells, and more particularly to expandable anchors set by a conical mandrel or pressure and that features external ribs in a manner to remain in position as expansion takes place.

BACKGROUND OF THE INVENTION

Liner hangers have been used to mechanically support the upper end of a liner from the lower end of previously set well casing and to seal the liner to the casing. Traditional liner hangers utilize slips for mechanically supporting the liner from the casing and packers to provide the seal between the liner and casing. Traditional liner hangers are complex, expensive and provide some uncertainty as to their operation downhole. More recently, expandable liner hangers have been developed which provide both mechanical support and a fluid seal by use of several elastomeric rings on a section of expandable tubing. However, the properties of elastomeric rings are susceptible to high temperatures and pressures. Accordingly, it is an object of this invention to provide improved expandable liner hangers suitable for use in high pressure and temperature environments by employing a metal-to-metal anchoring system.

BRIEF SUMMARY OF THE INVENTION

A liner hanger according to an embodiment of the invention includes a tubular member having a plurality of circular ridges extending along its periphery. A liner is attached to a downhole portion of the tubular member. A sealing member surrounds another portion of the tubular member. The tubular member is expandable so that the ridges come into contact with well casing but do not form a metal to metal seal with the casing thus securing the liner to the casing.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

The present disclosure relates to equipment and operations performed in a subterranean well and, more particularly, to an improved liner hanger or an anchoring system. To facilitate a better understanding of the present disclosure, the following examples of certain embodiments are given. The following examples should not be read to limit, or define, the scope of the disclosure. Embodiments of the present disclosure may be applicable to horizontal, vertical, deviated, or otherwise nonlinear wellbores. To further illustrate various illustrative embodiments of the present invention, the following examples are provided.

Figure 1:
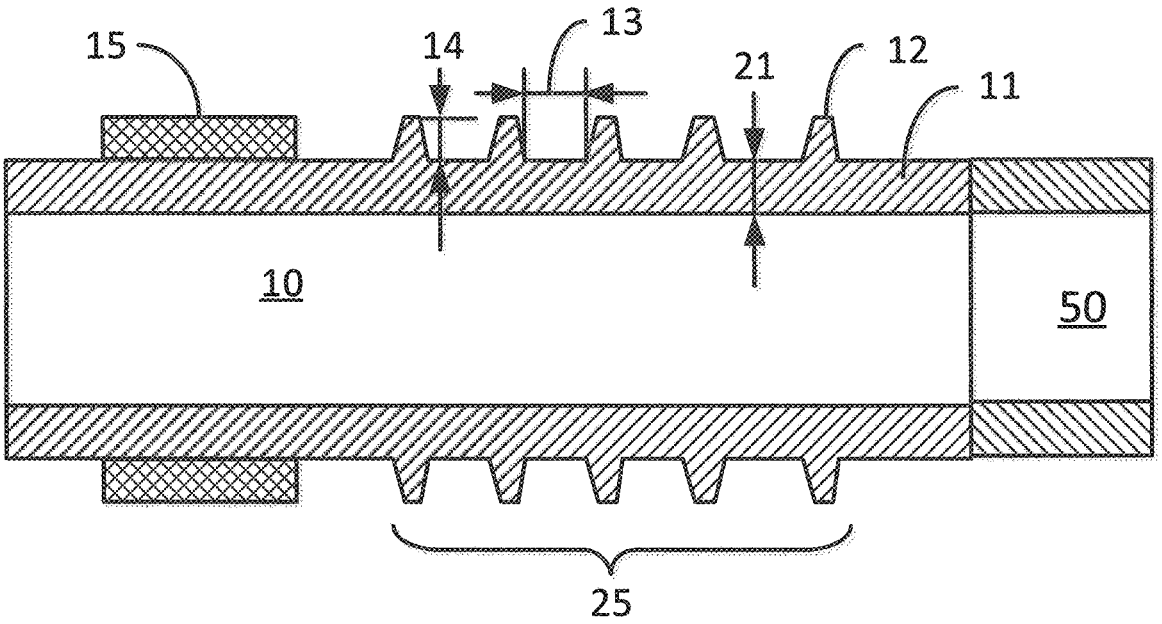
FIG. 1 illustrates a section view of an expandable liner hanger prior to expansion.

FIG. 1 schematically shows a cross-section of the liner hanger (LH) 10 coupled to a liner 50 before expansion. The LH is a tubular 11 comprising a sealing element 15 and an anchoring element 25 with ridges 12 on its outer perimeter of the tubular. The sealing element 15 may be made of any suitable material such as rubber or other polymeric materials or it may comprise metal ridges or combination thereof. Upon radial expansion, the sealing element provides the seal between the LH and the well casing 17, see FIG. 2.

The ridges 12 may be in the shape of axially spaced circular rings that extend along an outer perimeter of the tubular 11. In certain implementations, the ridges 12 may have different surface geometries without departing from the scope of the present disclosure. The ridges 12 may be metal ridges. The metal ridges may be made of any suitable steel grade, aluminum, any other ductile material, and a combination thereof. The ridges may be formed any suitable method known to those of ordinary skill in the art. For example, the ridges may be formed by machining the anchor body. However, any suitable methods known to one of ordinary skill in the art may be used to form the ridges 12. For example, the ridges may be formed as a separate structure that can be coupled to the tubular 11 using any suitable coupling mechanism known to one of ordinary skill in the art. The number of ridges formed along the axial direction of the anchoring element 25 may depend on the anchoring capacity desired to be reached.

Figure 2:
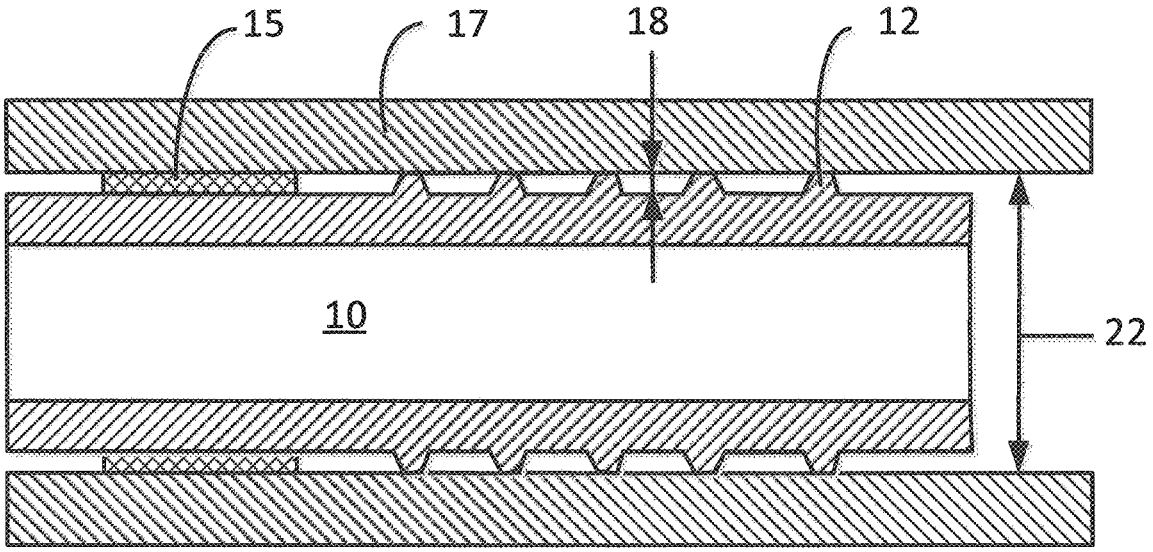
FIG. 2 illustrates a section view of a liner hanger of FIG. 1 after expansion inside well casing.

The height 14 of the ridges 12 may be selected to accommodate for the variations in internal diameter 22 of the base casing 17, see FIG. 2. According to the API, 5CT Specification for Casing and Tubing the internal diameter 22 of the base casing may vary between the maximum internal diameter, IDmax, and the minimum internal diameter, IDmin. The ridges need to be set in interference contact with base casing having IDmax to provide support a liner as required. At the same time, when LH is expanded in the casing with internal diameter less than IDmax the ridges need to be substantially radially plastically deformed to minimize overstressing of base casing and expansion force. Thus, the height 14 of the ridges are selected to be not less than the difference, $\Delta R$, between radii corresponding to maximum and minimum diameters of base casing and preferably 1.5-3 times the radial difference $\Delta R$.

The distance 13 between ridges may be configured such that the elastic residual stresses, caused by tubular expansion in the LH tubular portions between the ridges amplifies the interference forces between the ridges and the base casing to maximize the anchoring capacity per ridge. It was found by utilizing finite element analysis (FEA) that optimum distances 13 between the ridges may be not less than the tubular thickness 21 and preferably 1.5-3 times the thickness 21 of the tubular. The term "anchoring capacity" as used herein is defined as the maximum longitudinal force the LH can carry without appreciable relative displacement between the LH and the base casing.

Figure 3:
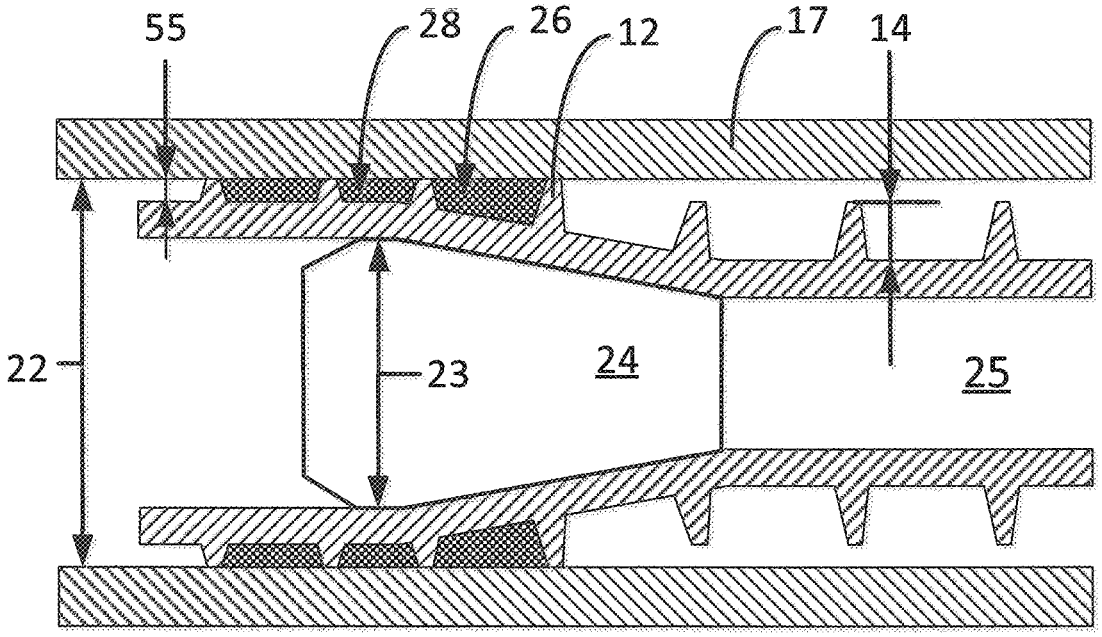
FIG. 3 illustrates a cross-sectional view of an anchoring element of the liner hanger of FIG. 1 being expanded by an expansion cone.

The LH may be expanded by a conical swage 24, see FIG. 3 schematically showing expansion of the anchoring element of the LH shown in FIG. 1. The expansion cone 24 has a diameter 23 such that upon expansion of the anchoring element inside the IDmax casing, the ridges 12 come in interference contact with the base casing thus providing a certain hanging capacity of the LH. When the anchoring element is expanded inside casing with internal diameter less than IDmax the ridges 12 undergo plastic radial deformation resulting in reduction of their height from original height 14 to compressed height 55.

It was found experimentally that when LH comprising circular ridges is expanded inside casing with internal diameter less than IDmax in the presence of the drilling fluids its anchoring capacity may be significantly less (up to 45%) than when it is expanded in the air.

The FEA showed that the presence of the drilling fluid having low compressibility (high bulk modulus) trapped in the cavities between the ridges and compressed in the cases where casing internal diameter is less than IDmax significantly reduces interference contact forces between the ridges and base casing resulting in low anchoring capacity of the LH. The fluid becomes trapped between tubular 11 and base casing 17 in the cavities 26 when the ridges 12 come in contact with the base casing 17, see FIG. 3. When LH is expanded within the casing with internal diameters less than IDmax the ridges are radially plastically deformed to the height 55, see FIG. 3, significantly less than their original height 14. This reduces the volume of the cavities 26 to a smaller volume of cavity 28 resulting in high pressure applied to the casing and the tubular portion between the ridges which reduces the interference contact forces between the ridges and the base casing and thus reduces the anchoring capacity of the LH.

Figure 4:
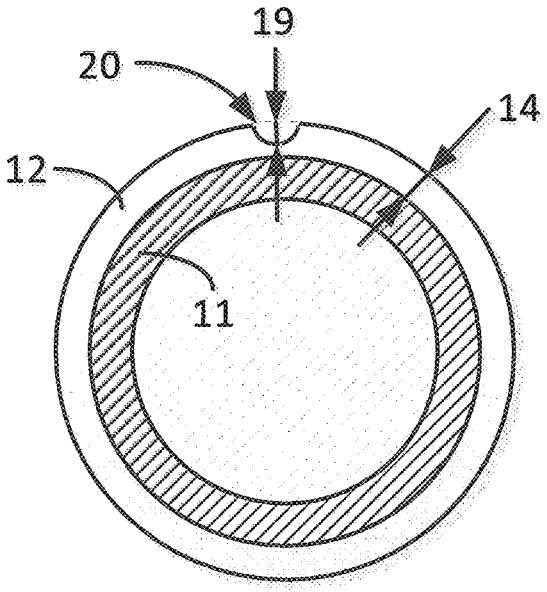
FIG. 4 illustrates a sectional view of the liner hanger of FIG. 1 including flow relief grooves.

It was found that incorporation of flow relief grooves 20 in the circular ridges 12, see FIG. 4, results in the significant improvement LH hanging capacity when LH is expanded in the drilling fluids. The relief grooves allow flow of the liquid out of cavities between ridges upon plastic radial compression of the ridges preventing compression of the fluid which results in the same anchoring capacity of LH after expansion in drilling fluids as after expansion in the air. The depth 19 of the flow relief grooves 20 may be selected to be approximately two thirds of the groves height 14 to accommodate for the liquid flow out of the cavities 26, see FIG. 3, upon radial plastic compression of the groves 12.

The particular embodiments disclosed above are illustrative only, as the present disclosure may be modified and practiced in different but equivalent manners apparent to those skilled in the art having the benefit of the teachings herein. The scope and spirit of the present disclosure is that the circular ridges of the liner hanger do not provide metal-to-metal seal between the liner hanger and the casing, when the LH is in expanded position, which allows liquid communication between cavities between ridges eliminating hydrostatic pressure buildup. This can be achieved by many different methods, for example by providing holes in the ridges or using an elliptical shape for ridges, etc.

Operationally, a liner coupled to a liner hanger in accordance with an implementation of the present disclosure may be lowered to a desired position downhole. Then, the liner hanger is radially expanded bringing liner hanger ridges in high interference metal-to-metal contact with an inner surface of the well casing providing coupling of the liner to the casing.

Figure 5:
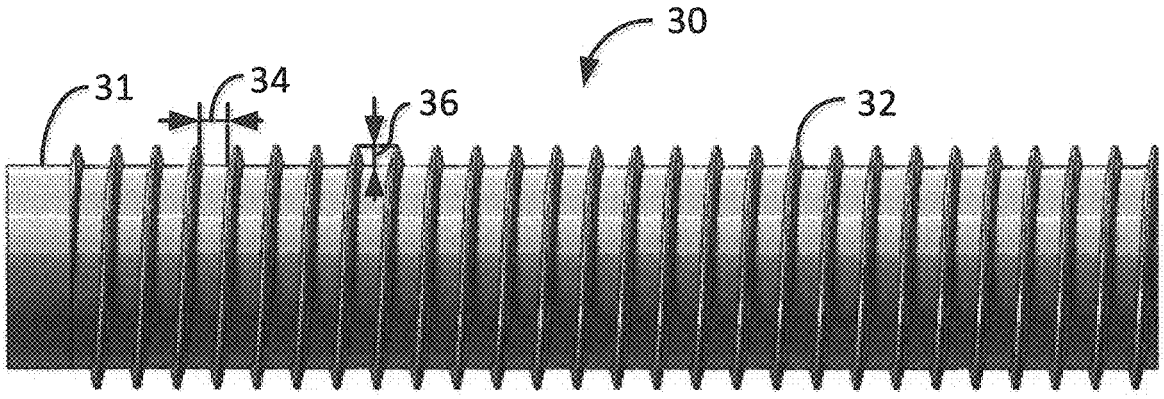
FIG. 5 illustrates a view of a liner hanger including a spiral anchoring ridge.

Another embodiment of the present invention is illustrated schematically in FIG. 5. The LH anchoring element 30 includes a tubular 31 with the ridge 32 on its outer diameter extending along an outer perimeter of the tubular in longitudinal direction in a helical form. The shape and the height 36 of the ridge 32 may be selected from the same considerations as described above for the anchoring element 30. Also, the pitch of the helix 34 of the ridge 32 may be selected from considerations analogous to the selection of the distance 13 between the circular ridges of anchoring element 30. The helical shape of the ridge 32 provides continues passage for the drilling liquid through the pitch cavity of the helix. Thus, upon plastic radial expansion of the anchoring element 30 the ridge 32 comes in high interference contact with the base casing without generation of hydrostatic pressure between liner hanger and the casing, which provides a high hanging capacity as when it is expanded in the air.

Although the present invention and its advantages have been described in detail, it should be understood that various changes, substitutions and alterations may be made herein without departing from the spirit and scope of the invention as defined by the appended claims.

What is claimed is:

1. A system for performing subterranean operations comprising:

a liner hanger coupled to a liner;

wherein the liner hanger comprises an anchoring element having a plurality of metal ridges in a shape of axially spaced circular rings of ductile material extending along an outer perimeter of the anchoring element, wherein the liner hanger is expandable, wherein the metal ridges are adapted to come in interference contact with a wellbore casing and plastically deform when the liner hanger is in an expanded position, wherein the metal ridges do not provide a metal to metal seal between the anchoring element of the liner hanger and the wellbore casing when the liner hanger is in the expanded position, and wherein the metal ridges have a first height relative to the outer perimeter of the anchoring element prior to expansion and the metal ridges are adapted to have a reduced second height relative to the outer perimeter upon plastic deformation.

2. The system of claim 1, wherein the liner hanger and the anchoring element with the metal ridges are of a uniform body, whereby the metal ridges are formed by machining the anchoring element.

3. The system of claim 1, wherein the metal ridges include relief grooves providing fluid communication between the metal ridges and the wellbore casing.

4. The system of claim 1, further comprising a sealing element configured to provide a seal between the liner hanger and the wellbore casing upon radial expansion of the liner hanger.

5. The system of claim 4, wherein the sealing element includes an elastomeric element.

6. The system of claim 4, wherein the sealing element is an annular ring surrounding the liner hanger.

7. The system of claim 1, wherein the wellbore casing has a maximum internal diameter and a minimum internal diameter, and wherein a height of the metal ridges is from 1.5X to 3X the difference between a radius of the maximum internal diameter and a radius of the minimum internal diameter.

8. The system of claim 1, wherein the liner hanger further comprises a hanger tubular having a thickness, and wherein a distance between two adjacent metal ridges of the plurality of metal ridges is from 1.5X to 3X of the thickness of the hanger tubular.

9. A method for coupling a liner to a casing of a cased wellbore in a subterranean formation comprising:

coupling a liner hanger to the liner, wherein the liner hanger comprises an anchoring element having a plurality of metal ridges in a shape of axially spaced circular rings of ductile material extending along an outer perimeter of the anchoring element, wherein the plurality of metal ridges have a first height relative to the outer perimeter;

lowering the liner and the liner hanger downhole through the casing and positioning the liner hanger inside the casing;

expanding the liner hanger and plastically deforming the metal ridges, thereby bringing the metal ridges of the anchoring element in interference contact with the casing, wherein the metal ridges do not provide a metal to metal seal between the anchoring element of the liner hanger and the casing when the liner hanger is in an expanded position, wherein the metal ridges have a reduced second height relative to the outer perimeter after expansion, and wherein the expansion of the liner hanger couples the liner hanger to the casing.

10. The method of claim 9, wherein the liner hanger and the anchoring element with the metal ridges are of a uniform body, whereby the metal ridges are formed by machining the anchoring element.

11. The method of claim 9, wherein the metal ridges include relief grooves providing fluid communication between the ridges and the casing.

12. The method of claim 9, wherein the liner hanger further comprises a sealing element configured to provide a seal between the liner hanger and the casing upon radial expansion of the liner hanger.

13. Method of claim 12, wherein the sealing element includes an elastomeric element.

14. The method of claim 12, wherein the sealing element is an annular ring surrounding the liner hanger.

15. The method of claim 9, wherein the liner hanger is expanded by a conical swage.

16. The method of claim 9, wherein the liner hanger is expanded by pressure.

17. A system for performing subterranean operations comprising:

an expandable liner hanger coupled to a liner;

wherein the liner hanger comprises an anchoring element having a plurality of metal ridges in a shape of axially spaced circular rings of ductile material extending along an outer perimeter of the anchoring element, wherein the metal ridges are adapted to come in interference contact with a wellbore casing and plastically deform in preference to the wellbore casing and to a reduced height when the liner hanger is in an expanded position, and wherein the metal ridges do not provide a metal to metal seal between the anchoring element of the liner hanger and the wellbore casing when the liner hanger is in the expanded position.

* * * * *